US005630650A

United States Patent [19]

Peterson et al.

[11] Patent Number: 5,630,650

[45] Date of Patent: May 20, 1997

[54] VERTICALLY ADJUSTABLE BACK CONSTRUCTION FOR SEATING

[75] Inventors: Gordon J. Peterson; Arnold B. Dammermann, both of Grand Rapids; Charles P. Roossien, Wyoming; David L. Rundhaug, Grand Rapids; James M. Mancewicz, Wyoming, all of Mich.

[73] Assignee: Steelcase Inc., Grand Rapids, Mich.

[21] Appl. No.: 220,041

[22] Filed: Mar. 30, 1994

[51] Int. Cl.[6] ..... B60N 2/02

[52] U.S. Cl. ..... 297/353; 297/284.1

[58] Field of Search ..... 297/285, 284.3, 297/284.7, 301, 353, 300.1, 300.2

[56] References Cited

U.S. PATENT DOCUMENTS

| | | | |
|---|---|---|---|
| D. 309,383 | 7/1990 | Muller-Deisign et al. | D6/366 |
| D. 311,286 | 10/1990 | Muller-Deisig et al. | D6/366 |
| D. 312,003 | 11/1990 | Muller-Deisig et al. | D6/366 |
| D. 312,536 | 12/1990 | Muller-Deisig et al. | D6/366 |
| D. 318,184 | 7/1991 | Muller-Deisig et al. | D6/366 |
| 3,526,430 | 9/1970 | Eldon, III | 297/353 |
| 4,012,158 | 3/1977 | Harper | 403/107 |
| 4,015,878 | 4/1977 | Perkins | 297/353 |
| 4,221,430 | 9/1980 | Frobose | 297/353 |
| 4,384,742 | 5/1983 | Wisniewski | 297/353 |
| 4,451,084 | 5/1984 | Seeley | 297/353 |
| 4,573,737 | 3/1986 | Korn | 297/353 |
| 4,616,877 | 10/1986 | Slaats et al. | 297/353 |
| 4,639,039 | 1/1987 | Donovan | 297/353 |
| 4,660,885 | 4/1987 | Suhr et al. | 297/353 |
| 4,662,681 | 5/1987 | Favaretto | 297/349 |
| 4,662,682 | 5/1987 | Maurel | 297/353 |
| 4,709,894 | 12/1987 | Knoblock et al | 298/406.2 |
| 4,711,491 | 12/1987 | Ginat | 297/301 |
| 4,718,153 | 1/1988 | Armitage et al. | 29/91.1 |
| 4,720,142 | 1/1988 | Holdredge et al. | 297/300 |
| 4,744,603 | 5/1988 | Knoblock | 297/457 |
| 4,776,633 | 10/1988 | Knoblock et al. | 287/300 |
| 4,786,108 | 11/1988 | Dauphin | 297/353 |
| 4,872,635 | 10/1989 | Knoblock et al. | 248/406.2 |
| 4,930,840 | 6/1990 | Tornero | 297/353 |
| 4,979,778 | 12/1990 | Shields | 297/301 |
| 5,007,678 | 4/1991 | DeKraker | 297/353 |
| 5,037,158 | 8/1991 | Crawford | 297/353 |
| 5,050,931 | 9/1991 | Knoblock | 297/311 |
| 5,193,880 | 3/1993 | Keusch et al. | 297/353 |
| 5,217,278 | 6/1993 | Harrison et al. | 297/284.7 |
| 5,232,265 | 8/1993 | Estkowski et al. | 297/353 |

*Primary Examiner*—Milton Nelson, Jr.

*Attorney, Agent, or Firm*—Price, Heneveld, Cooper, DeWitt & Litton

[57] ABSTRACT

A vertically adjustable back construction is provided for chairs and the like of the type having a one-piece sculptured appearance. The back construction includes a lower back member with an upholstered upright portion, and an upper back member slidably mounted on the lower back member for movement between various back heights. The upper back member includes an upholstered, downwardly opening shroud portion, which is disposed over and covers at least the uppermost end of the upright portion on the lower back member, and translates thereover to permit ready vertical adjustment of the upper back member by the user to accommodate different tasks and users, while preserving the one-piece sculptured appearance of the chair.

40 Claims, 7 Drawing Sheets

VERTICALLY ADJUSTABLE BACK CONSTRUCTION FOR SEATING

BACKGROUND OF THE INVENTION

The present invention relates to seating and the like, and in particular to a vertically adjustable back construction therefor.

Vertically adjustable back constructions for seating are generally well known in the art, and typically permit the height of the seat back to be positioned at different locations to accommodate various users and circumstances. One example of such adjustable seat back constructions can be found in U.S. Pat. No. 5,007,678 to DeKraker, which is assigned to Steelcase Inc., assignee of the present application. Typically, such vertically adjustable back mechanisms can not be manipulated by the user himself from a comfortable, natural seated position in the chair, but rather require the user to either get up out of the chair, or to reach in a manner which displaces the user from a normal sitting position. Consequently, vertical adjustment of the back is not always accurate, and can not be achieved very quickly.

A unique type of office chair was recently developed by Steelcase Inc., which is presently marketed under the "SENSOR" trademark. This new chair has a very distinctive, one-piece sculptured appearance, as if chiseled from a solid block of material, and is the subject of many issued and pending U.S. Pat. Nos., including U.S. patents 4,776,633; 4,720,142; 4,709,894; 5,050,931; 4,744,603; D 311,286; D 309,383; D 312,536 and D 312,003. The overall lines of the "SENSOR" chair are quite clean, sleek and uncluttered, and the sitting surfaces have a very soft warm appearance, with formed contours that imitate the shape of the human body. A novel molding technique is provided to manufacture a one-piece molded upholstered cushion assembly that is used in the "SENSOR" chair, as disclosed in U.S. Pat. No. 4,718,153. The "SENSOR" chair has met with widespread commercial acceptance, and is generally considered to be the single, most successful office seating product on the market today. Several million "SENSOR" chairs have been sold to date, and they are presently being used in offices throughout the world.

Work processes in the office continue to change, as more hours are spent performing task intensive jobs. Hence, highly adjustable seating is rapidly becoming the fastest growing segment in the seating market, so as to keep pace with new technologies, diversified job responsibilities, shared offices, and other similar factors. Many users have standardized on and invested heavily in the "SENSOR" chair, and are anxious to preserve this important investment. It is particularly important in open office environments to maintain a common visual theme for the seating, so as to avoid a piecemeal or cluttered appearance.

Heretofore, vertically adjustable back constructions have been designed largely for use in conjunction with secretarial or task chairs of the type that have separate seat and back cushions, such as the chair disclosed in the above noted DeKraker U.S. Pat. No. 5,007,678. However, such back constructions are not particularly adapted for use in conjunction with seating that has a one-piece sculptured appearance, such as the "SENSOR" chair.

SUMMARY OF THE INVENTION

One aspect of the present invention is to provide a vertically adjustable back construction for chairs and the like of the type having a one-piece sculptured appearance. The back construction includes a lower back member with an upholstered upright portion, and an upper back member slidably mounted on the lower back member for vertical movement between various back heights. The upper back member includes an upholstered, downwardly opening shroud portion, which is disposed over and covers at least the uppermost end of the upright portion on the lower back member, and translates thereover to permit ready vertical adjustment of the upper back member by the user to accommodate different tasks and users, while preserving the one-piece sculptured appearance of the chair.

Another aspect of the present invention is a chair having a base and a seat operably connected therewith. The seat has a user interface surface adapted to receive a seat portion of a seated user thereagainst. A lower back member is operably connected with the base, and includes an upright portion. The lower back member has a user interface surface that is positioned contiguous with the user interface surface of the seat, and is configured to mate with the same. An upper back member is slidably mounted on the lower back member for vertical adjustment, and includes a user interface surface which is positioned contiguous with the user interface surface of the lower back member, such that at least the forward portion of the chair has a one-piece sculptured appearance. The upper back member has a shroud portion, which is positioned over and covers at least the uppermost end of the upright portion of the lower back member, and translates thereover to permit ready vertical adjustment of the upper back member, while preserving the one-piece sculptured appearance of the chair.

The principal objects of the present invention are to provide a vertically adjustable back construction for chairs and the like of the type having a one-piece sculptured appearance. The back can be vertically adjusted between a wide variety of different heights to accommodate many different users and tasks, while preserving the one-piece sculptured appearance of the chair. A lock releasably connects the movable back in place, and includes a remotely positioned actuator that can be manipulated by a user seated in a comfortable, forwardly facing position in the chair to facilitate quick and accurate adjustment of the back, and achieve enhanced lumbar support. The adjustable back construction can be used in conjunction with a synchrotilt type of chair controller, so as to maintain seating comfort and good body support. The adjustable back construction is efficient in use, economical to manufacture, capable of a long operating life, and particularly well adapted for the proposed use.

These and other advantages of the invention will be further understood by those skilled in the art by reference to the following written specification, claims and appended drawings.

DETAILED DESCRIPTION OF THE PREFERRED EMBODIMENTS

Figure 1:
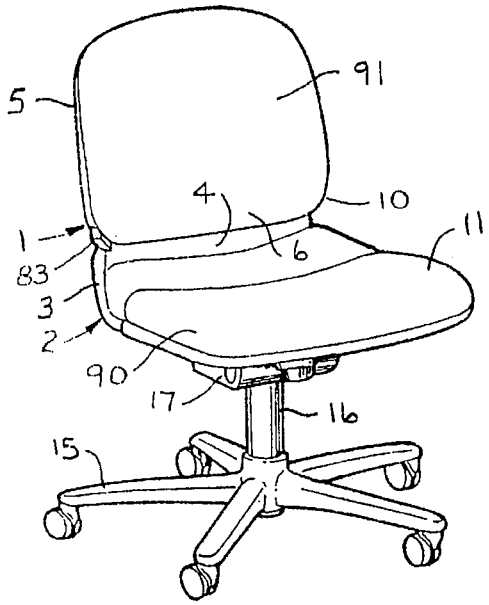
FIG. 1 is a front perspective view of a chair including a vertically adjustable back construction embodying the present invention, wherein an upper back portion of the chair is shown in a fully lowered position.
Figure 2:
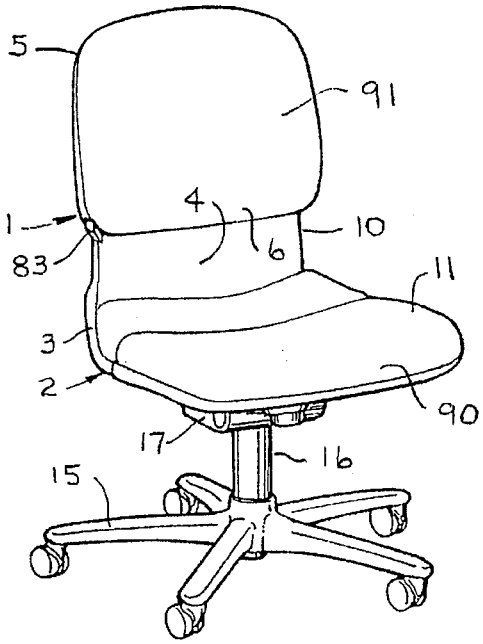
FIG. 2 is a front perspective view of the chair shown in FIG. 1, wherein the upper back member is shown in a fully raised position.
Figure 3:
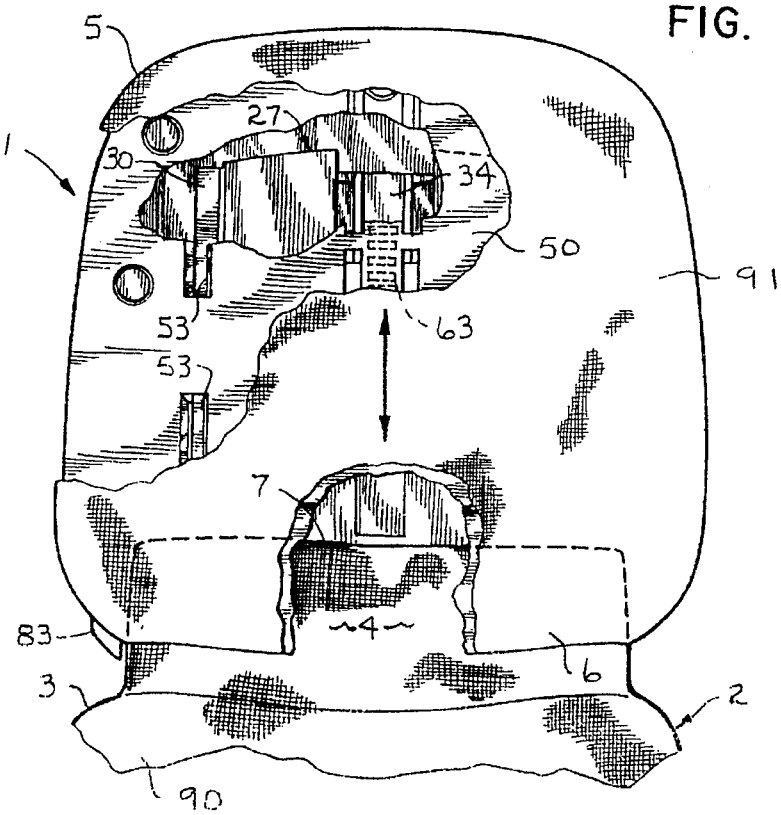
FIG. 3 is a fragmentary, front elevational view of the chair, wherein portions of the upper back member are broken away to reveal internal construction.

For purposes of description herein, the terms "upper," "lower", "right," "left," "rear," "front," "vertical," "horizontal," and derivatives thereof shall relate to the invention as oriented in FIGS. 1–3, and with respect to a seated user. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1–3) generally designates a vertically adjustable back construction for seating and the like of the type having a one-piece sculptured appearance, such as the illustrated chair 2. Back construction 1 includes a lower back member 3 with an upright portion 4, and an upper back member 5 slidably mounted on lower back 3 for movement between various back heights, as illustrated in FIGS. 1–3. The upper back 5 includes a downwardly opening shroud portion 6, which is disposed over and covers at least the uppermost end 7 of the upright portion 4 on lower back 3, and translates thereover to permit ready vertical adjustment of the upper back 5 by the user to accommodate different tasks and circumstances, while preserving the one-piece sculptured appearance of chair 2.

The illustrated vertically adjustable back construction 1 is shown incorporated into a "SENSOR" chair, which is the subject of prior U.S. Pat. Nos. 4,718,153; 4,776,633; 4,720,142; 4,709,894; 5,050,931; 4,744,603; D 311,286; D 309,383; D 312,536; D 312,003, as well as related continuations and divisions thereof, all of which are hereby incorporated herein by reference. However, it is to be understood that back construction 1 can also be used in conjunction with other types of seating of the type having a one-piece sculptured appearance, whether upholstered or unupholstered.

Figure 4:
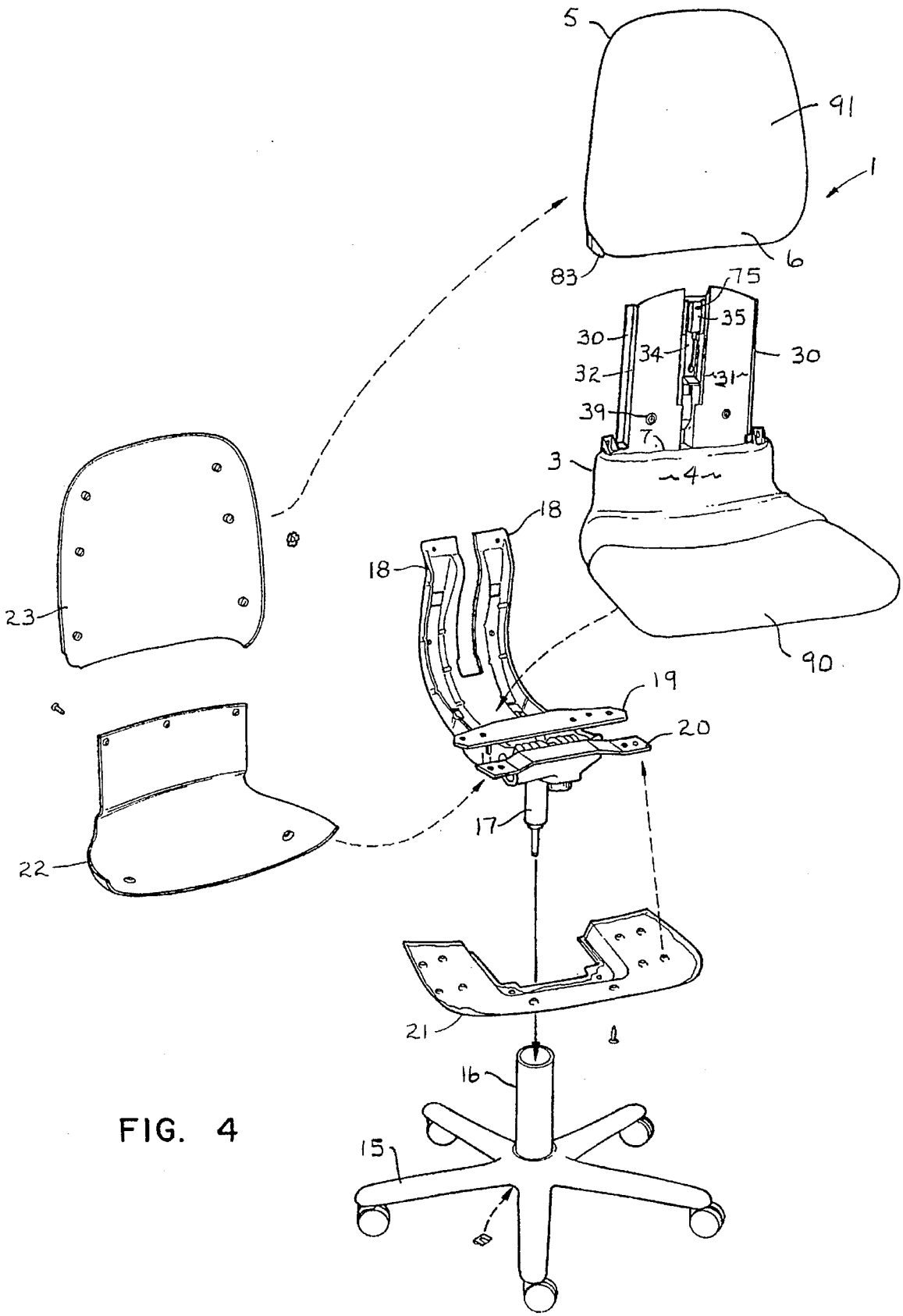
FIG. 4 is an exploded, perspective view of the chair.
Figure 5:
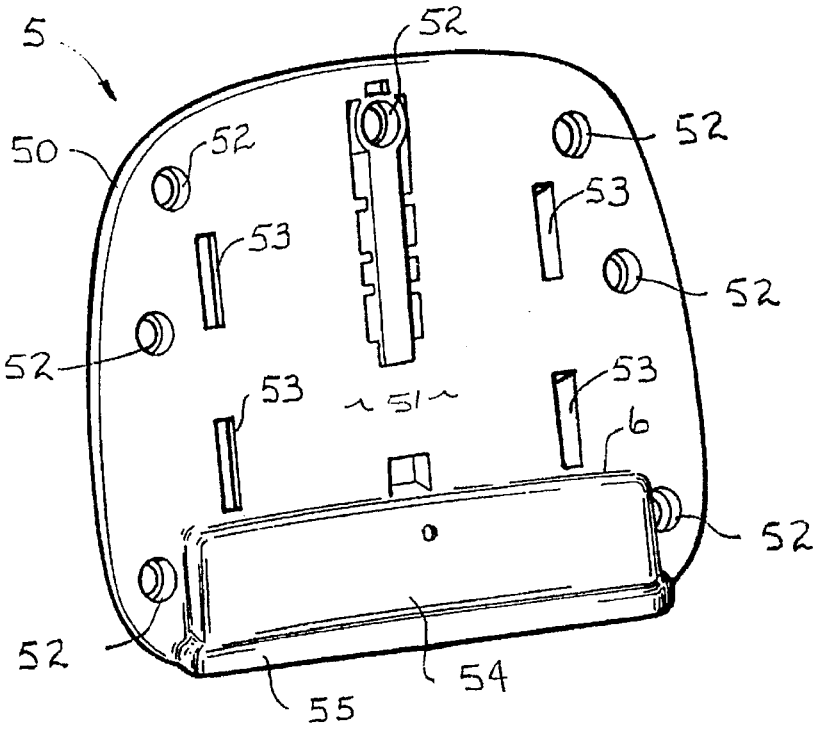
FIG. 5 is a perspective view of an inner shell portion of the upper back member.
Figure 6:
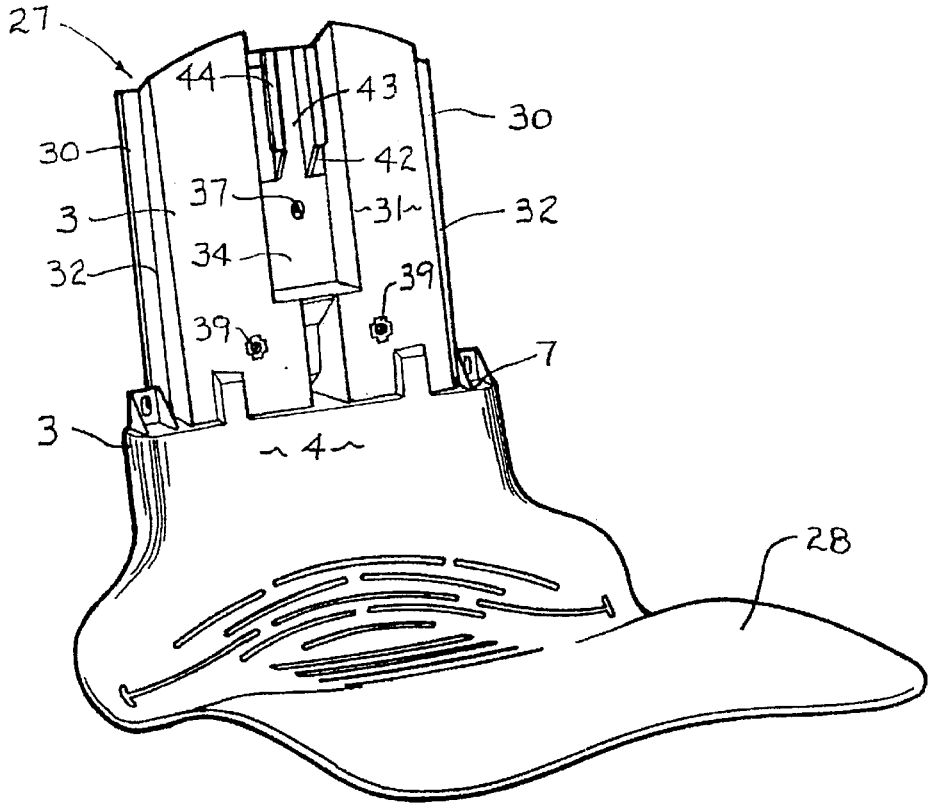
FIG. 6 is a perspective view of an inner shell portion of a lower back member.
Figure 7:
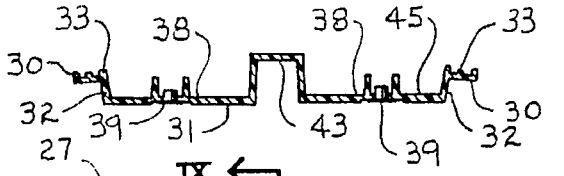
FIG. 7 is a horizontal, cross sectional view of the lower back inner shell, taken along the line VII—VII, FIG. 8.
Figure 8:
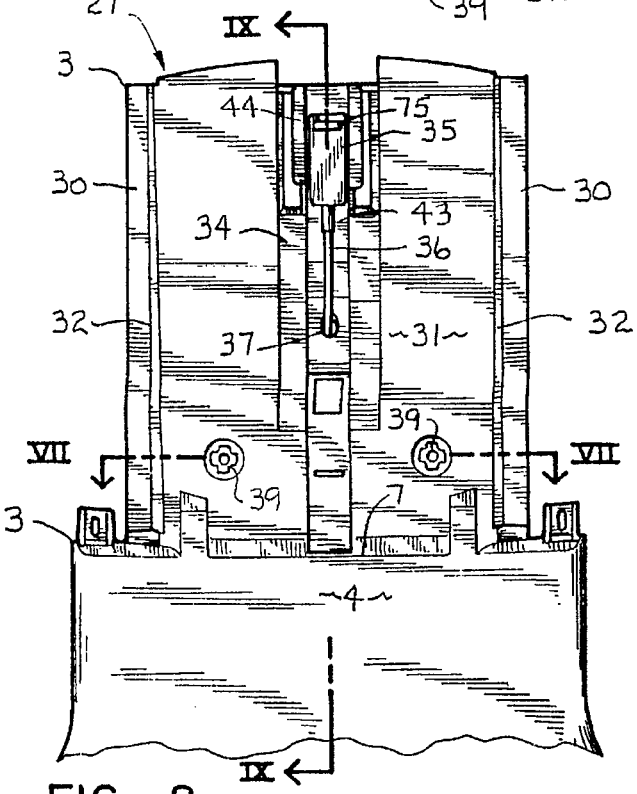
FIG. 8 is a fragmentary, front elevational view of the lower back inner shell.
Figure 9:
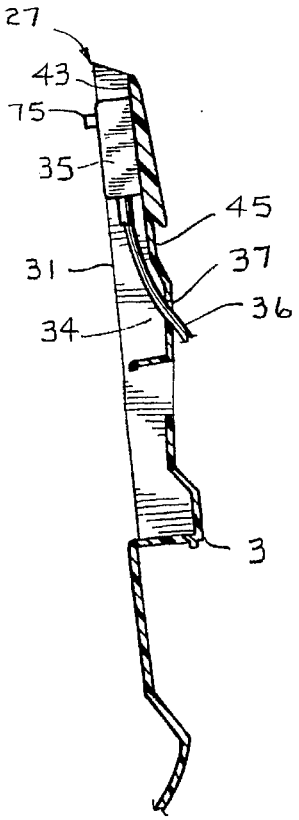
FIG. 9 is a vertical, cross-sectional view of the lower back inner shell, taken along the line IX—IX, FIG. 8.

With reference to FIG. 4, the illustrated chair 2 generally includes a five-legged, castered base 15, having an upstanding support column 16 with a synchrotilt type of chair control 17 mounted in the upper end thereof. Chair control 17 includes a pair of vertically extending uprights 18, which are configured to generally support the entire back portion 10 of chair 2, and two horizontally extending stretchers 19 and 20, which are configured to generally support the seat portion 11 of chair 2. As described in greater detail in the above noted related patents, uprights 19 are pivotably supported in control 17 to permit the back portion 10 of chair 2 to tilt rearwardly, and stretchers 19 and 20 are slidably supported in control 17 in a manner which permits the seat portion 11 to articulate when the back uprights 18 are tilted rearwardly, thereby achieving a synchrotilt type of chair control action. A first outer shell 21 is provided to enclose the front lower portion of chair 2, a second outer shell 22 is provided to cover the lower back portion of the chair back, and a third outer shell 23 is provided to cover the rear portion of upper back 5, in the fashion disclosed in greater detail hereinafter. Chair 2 has the overall configuration and appearance of the aforementioned "SENSOR" chair, including an hourglass shape with a tapered waist area.

With reference to FIGS. 6–10, the illustrated lower back member 3 is formed as an integral part of a one-piece inner shell 27, which includes a seat portion 28, as well as lower back portion 3. Inner shell 27 has a generally L-shaped side elevational configuration, with lower back portion 3 being oriented generally vertically, and seat portion 28 being oriented generally horizontally. Inner shell 27 has a complex shape, and is preferably formed by molding or the like from a resiliently reflexible synthetic material, such as polypropylene plastic or the like. The seat portion 28 of inner shell 27 is attached to the forward and rearward stretchers 19 and 20 of chair control 17 by suitable fasteners (not shown), so as to securely mount the same thereon in a manner which permits the inner shell seat portion 28 to both translate and flex. The back portion 3 of inner shell 27 is attached to the uprights 18 of chair control 17 by suitable fasteners (not shown), so as to securely mount the same thereon in a manner which permits the inner shell lower back portion 3 to tilt rearwardly.

Figure 10:
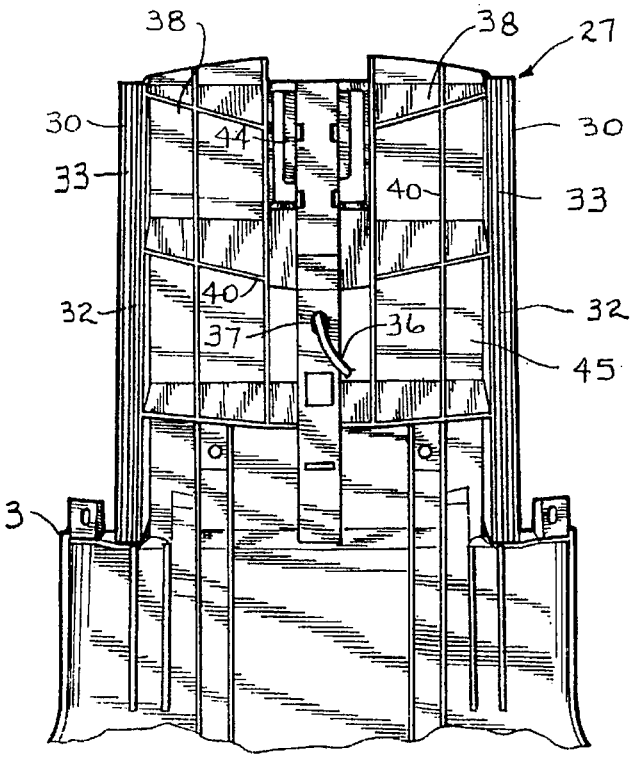
FIG. 10 is a fragmentary, rear elevational view of the lower back inner shell.
Figure 11:
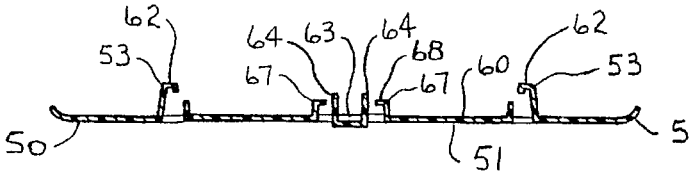
FIG. 11 is a horizontal, cross-sectional view of the inner shell upper back, taken along the line, XI—XI, FIG. 12.
Figure 12:
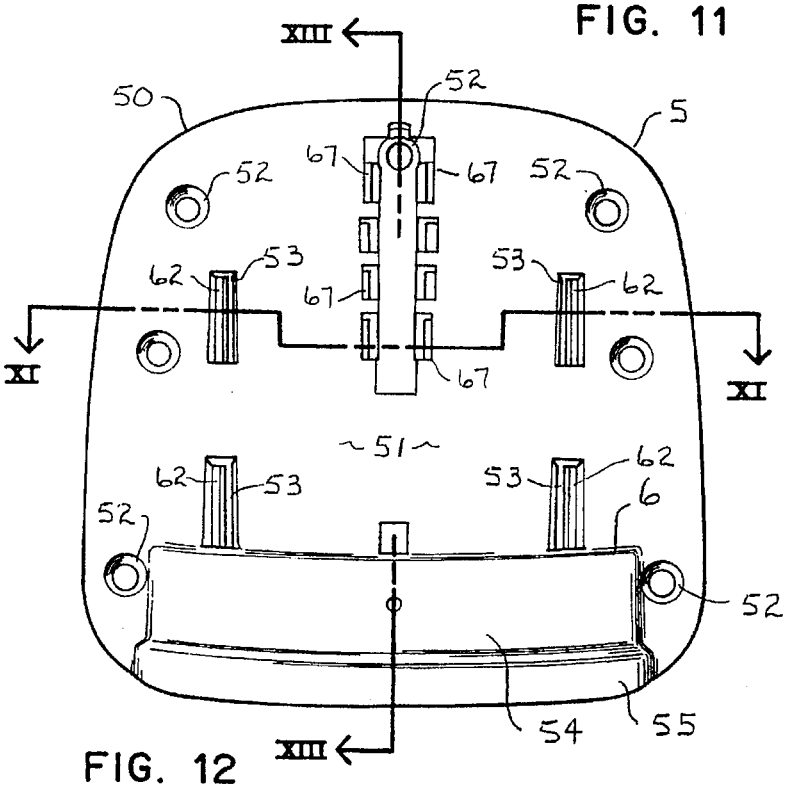
FIG. 12 is a front elevational view of the inner shell upper back.
Figure 13:
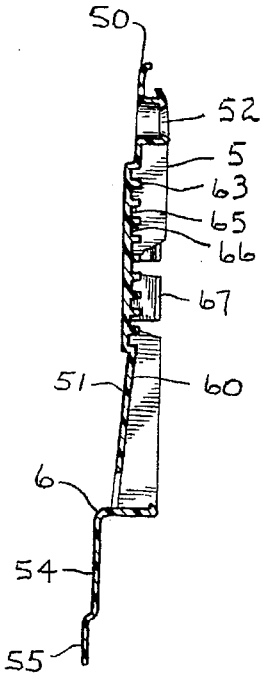
FIG. 13 is a vertical, cross-sectional view of the inner shell upper back, taken along the line XIII—XIII, FIG. 12.

In the example illustrated in FIGS. 6–10, lower back 3 has a generally channel-shaped construction, comprising a front surface 31 with a pair of L-shaped outer flanges 32 extending along the opposite sides thereof. Each of the outer flanges 32 has a rear leg 30 with three rearwardly projecting ribs 33 extending vertically therealong, which define slide rails or guides for slidably interconnecting lower and upper back members 3 and 5. A U-shaped recess 34 is positioned centrally in lower back 3, and extends longitudinally therealong. A pair of inverted L-shaped flanges 42 project outwardly from the base of recess 34 at an uppermost portion thereof, and define a central channel 43 therebetween. Flanges 42 include outwardly extending legs 44 which assist in slidably interconnecting the lower and upper back members 3 and 5, as described below. A lock mechanism 35 is mounted in U-shaped shell channel 43, and includes a flexible actuator cable 36 that extends through a centrally located aperture 37 in the base of recess 34 to route the same toward the rearward portion of chair 2. A pair of shallow channels 38 are formed on the rear surface 45 of lower back 3 between outer flanges 32 and central recess 34, and are shaped to receive the controller uprights 18 therein. A pair of threaded fastener bosses 39 are provided in the lower part of lower back 3 to facilitate mounting inner shell 27 to chair control 17. As best illustrated in FIG. 10, the rear surface 45 of inner shell lower back 3 includes a plurality of reinforcing ribs 40, which serve to selectively stiffen the same.

Figure 14:
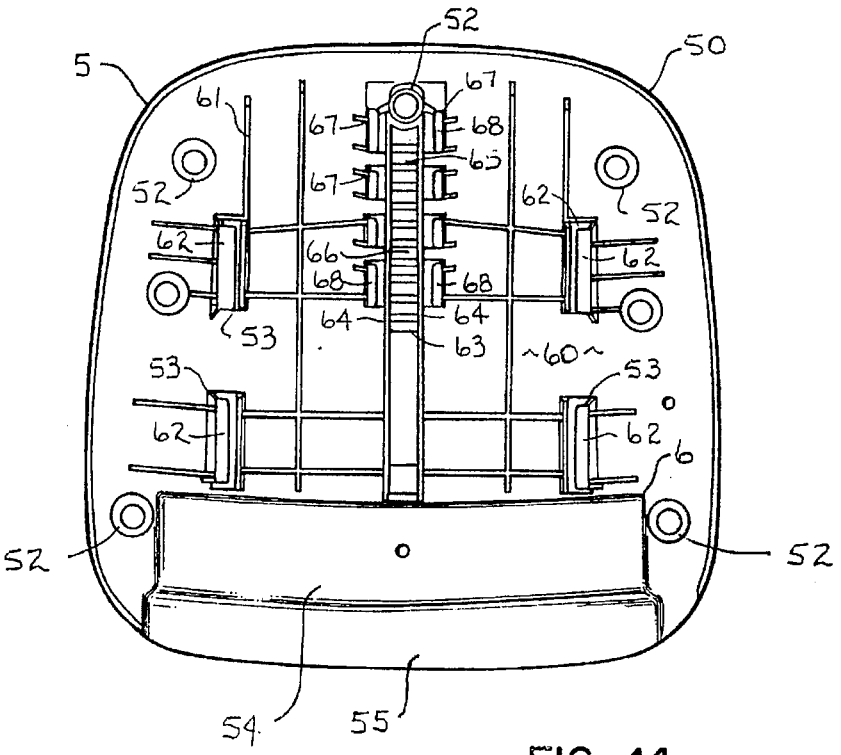
FIG. 14 is a rear elevational view of the inner shell upper back.

With reference to FIGS. 5 and 11–14, the illustrated upper back member 5 includes an inner shell 50, which also has a complex configuration, and is preferably formed by molding or the like from a resiliently flexible synthetic material, such as polypropylene plastic or other suitable materials. In the illustrated example, the forward surface 51 of upper back inner shell 50 is generally planar, and includes seven recessed fastener pockets and associated apertures 52 spaced apart about the periphery thereof, and four rearwardly projecting slide blocks 53. Shroud 6 is formed in the lower portion of upper back 5, and comprises an outwardly protruding pocket 54 in inner shell 50, having an inverted, generally U-shaped plan configuration into which the upright portion 4 of the lower back member 3 is closely received. Shroud pocket 54 has a slightly enlarged mouth or entry portion 55 to assist in guiding reciprocating action with the upright portion 4 of lower back 3. With reference to FIG. 14, the rear surface 60 of upper back inner shell 50 includes a plurality of ribs 61, which are arranged to selectively stiffen the same. Each of the slide blocks 53 has a generally L-shaped configuration, with an upper flange 62 positioned to slidably receive the side rails 30 on lower back 3 therein to slidably interconnect the upper and lower back members 5 and 3, and permit smooth vertical translation therebetween. A toothed rack 63 projects rearwardly from the rear surface 60 of upper back inner shell 50, and includes a pair of parallel side ribs 64, and a base 65 with approximately ten horizontally extending notches 66 therein. Rack 63 is adapted to be closely received within the U-shaped channel 43 of lower back member 3, and positions lock 35 adjacent notches 66 to selectively engage the same, as described in greater detail below. Four pairs of L-shaped interior slide blocks 67 are positioned on opposite sides of rack 63, and include inwardly extending legs 68, which slidably engage the legs 44 of lower back flanges 42 at the central portion of the back assembly 10. Rack 63 has a length which permits the upper and lower backs 5 and 3 to be vertically adjusted a distance of approximately three inches.

Figure 15:
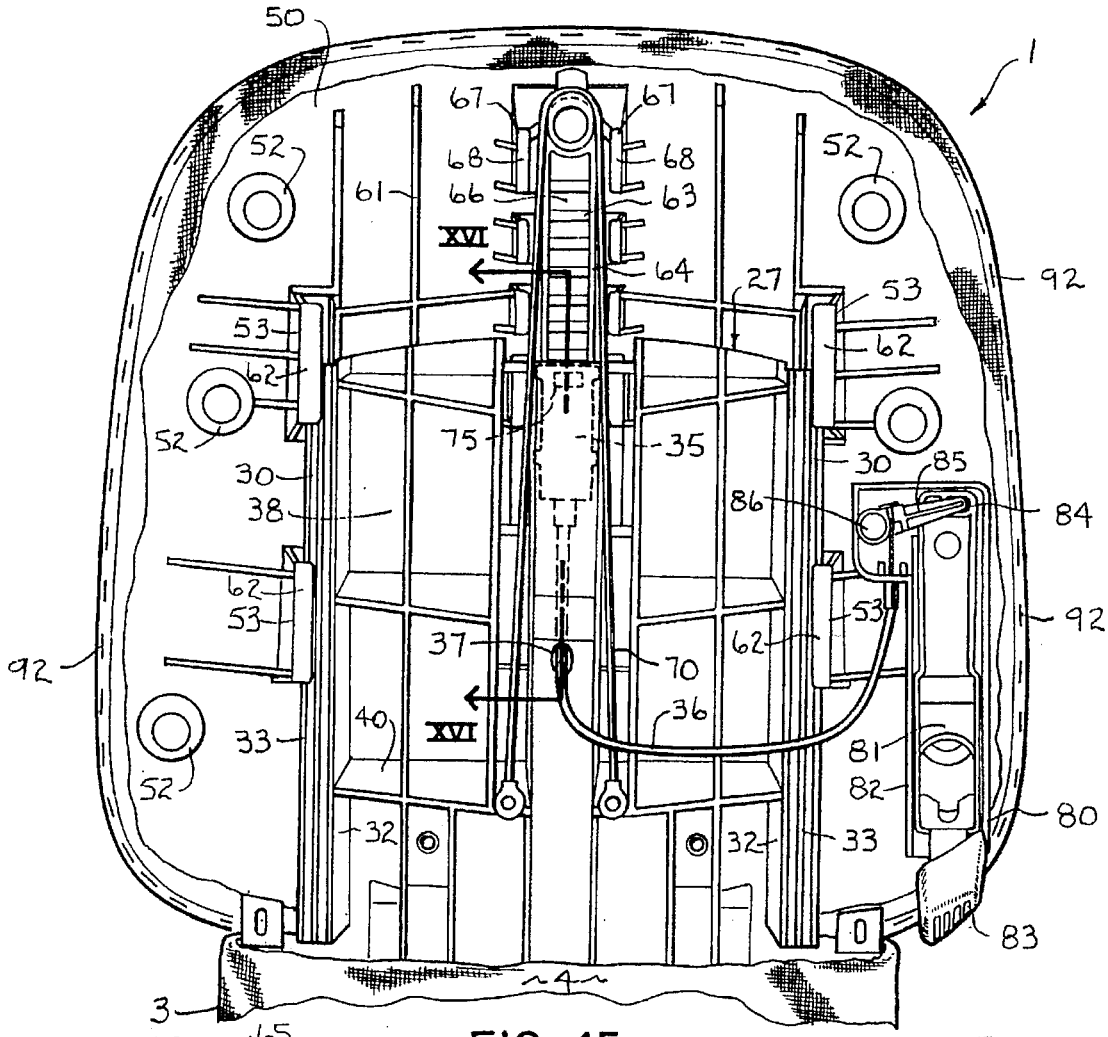
FIG. 15 is a rear elevational view of the assembled vertical adjustable back construction.
Figure 16:
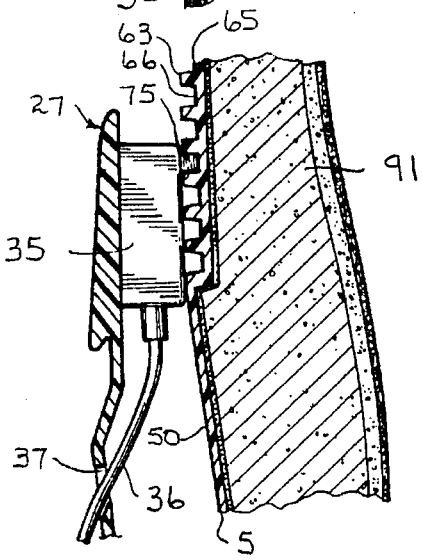
FIG. 16 is an enlarged, fragmentary, vertical cross-sectional view of the vertically adjustable back construction, showing a lock engaging an associated toothed rack.
Figure 17:
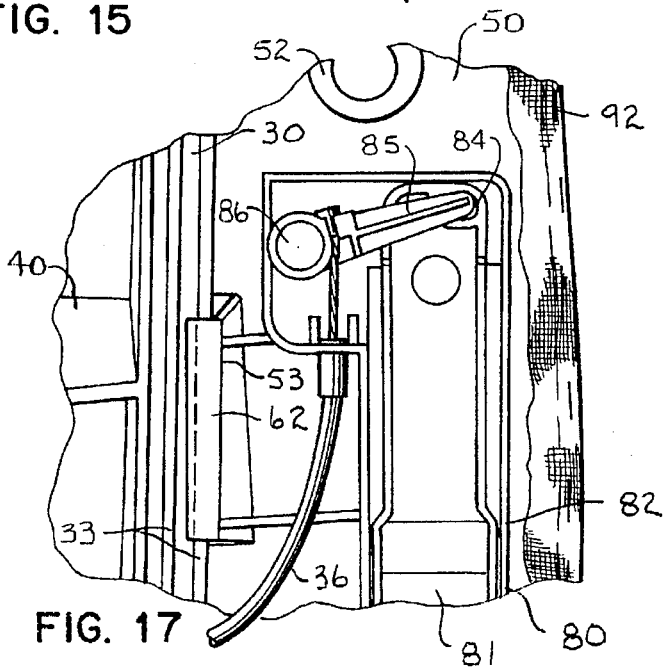
FIG. 17 is an enlarged, rear elevational view of an actuator for the lock.
Figures 18, 19:
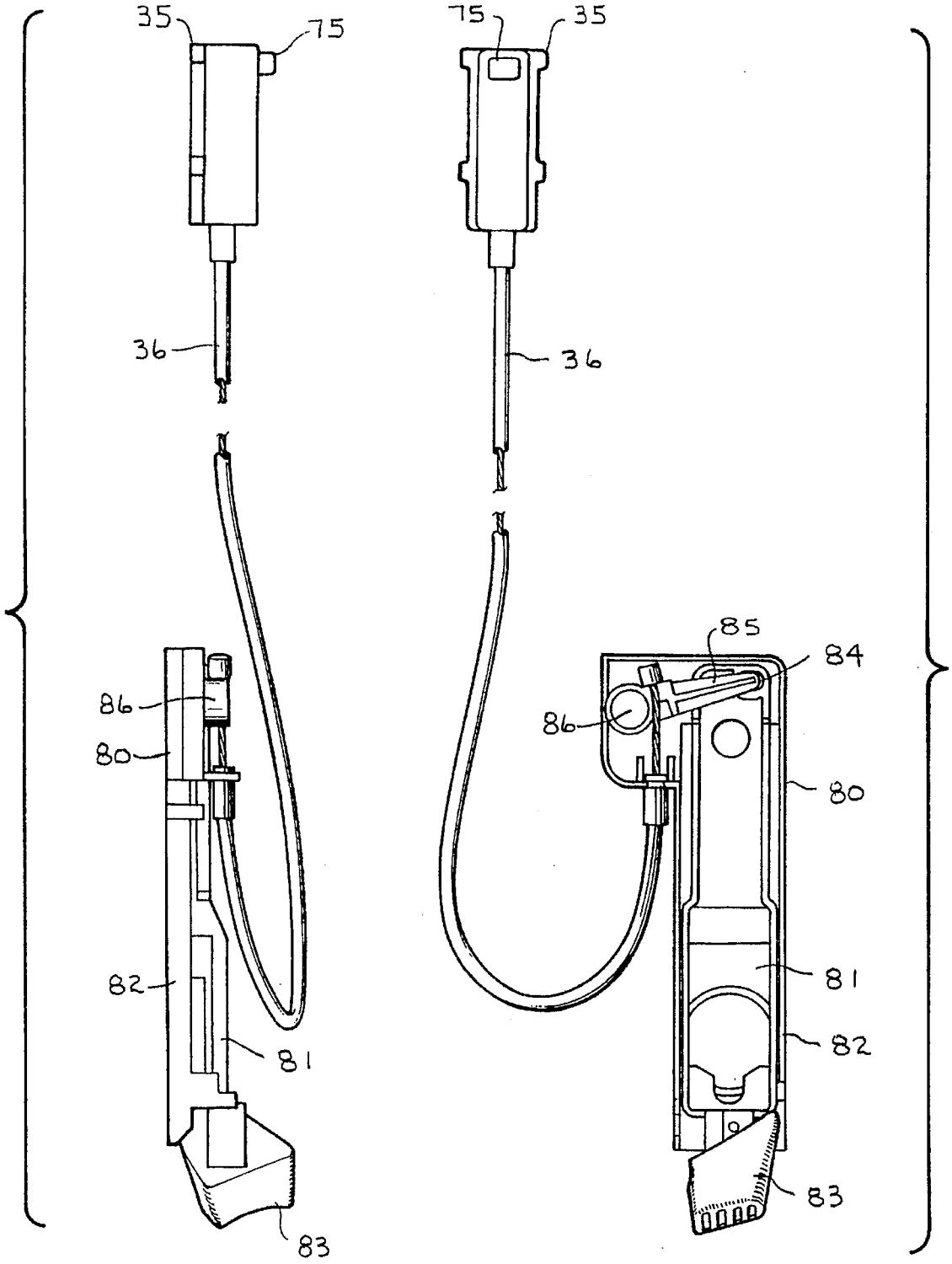
FIG. 18 is a rear elevational view of the lock actuator.
FIG. 19 is a side elevational view of the lock actuator.

With reference to FIGS. 15–17, the upper back inner shell 50 is slidably mounted on the lower back portion 3 of inner shell 27 by guiding the outer slide blocks 53 over the opposite side rails 30 of lower back member 3. The inner side blocks 67 on the rear surface 60 of upper back inner shell 50 slidingly mate with the outwardly extending flange legs 44 on the lower back portion 3 of inner shell 27. A resilient band 70 biases upper back member 5 downwardly toward its fully lowered position.

The illustrated lock 35 (FIGS. 15–19) includes a reciprocating pawl 75 shaped for close reception in the notches 66 of rack 63, as shown in FIG. 16. Pawl 75 can be shifted between the fully extended position shown in FIG. 16, to a fully retracted position, which permits the upper back member 5 to be manually shifted either upwardly or downwardly to another height to achieve enhanced lumbar support. The pawl portion 75 of lock 35 is reciprocated by manipulation of a remote actuator 80, which in the illustrated example comprises a vertical slide 81 mounted in an associated track 82 disposed adjacent the right-hand rear edge of upper back member 5. A button 83 is mounted on the lowermost end of slide 81, and projects downwardly from the side edge of upper back 5 for manual manipulation by a seated user. The upper end of slide 81 includes a slot 84 in which one end of an actuator lever 85 is pivotably received. The opposite end of actuator lever 85 is pivotably mounted to upper back member 5 by a pin 86, so that lever 85 pivots upon reciprocation of slide 81. The free end of actuator cable 36 is attached to lever 85 at a position adjacent pin 86, and is reciprocated upon manipulation of slide 81, so as to shift lock pawl 75 between the fully extended and fully retracted positions.

In the illustrated example, a seat cushion assembly 90 (FIG. 4) is provided to cover the upper, forwardly facing user interface surfaces of inner shell 27. Seat cushion assembly 90 is preferably molded as a one-piece unit that is shaped to cover the upper back portion 3 and seat portion 28 of inner shell 27, and is attached thereto by suitable fasteners (not shown). As best illustrated in FIG. 3, seat cushion assembly 90 extends to the uppermost end 9 of lower back member 3, so that when the upper back member 5 is raised, the underlying portion of the lower back is completely finished, and continues to blend in with the finished exterior surface of the upper back member 5 to preserve the one-piece sculptured appearance of chair 2. Outer shells 21 and 22 are attached to the lower and rear surfaces of inner shell 27 to fully enclose the same.

In the chair shown in FIGS. 1–4, a back cushion assembly 91 is provided to cover the outwardly facing user interface surfaces of upper back inner shell 50. Like seat cushion assembly 90, back cushion assembly 91 is preferably molded as a one-piece unit that is shaped to cover the forward surface 51 and side edges of upper back inner shell 50, and is attached thereto by suitable fasteners, such as staples 92 (FIG. 15). As best illustrated in FIGS. 1–3, back cushion assembly 91 extends completely over shroud pocket 54 to abuttingly mate with the upright portion 4 of seat cushion 90, so as to lie contiguous with the same. Outer shell 23 is attached to the rear surface 60 of upper back inner shell 50 to fully enclose the same, and complete the upper back assembly.

In operation, a user can easily adjust the height of upper back 5 from a comfortable, forwardly facing seated position within the chair 2. While sitting, the user simply grasps the lower back with one hand and pressing button 83 with one finger, shifts the same upwardly to release lock pawl 75. If upper back 5 is to be adjusted upwardly, additional force is applied to button 83 to overcome the forces of gravity and band 70, and thereby move upper back 5 to a higher position. If upper back 5 is to be adjusted downwardly, the user simply permits the force of gravity and band 70 to move upper back 5 to a lower position. The user then releases lock button 83, so as to securely lock the upper back 5 in its new selected position. The user can thereby adjust upper back 5 by using a single hand, such that his other hand remains free for other activities. Since the user can easily adjust the vertical location of upper back 5 from a natural, seated position in chair 2, the back adjustment can be made both quickly and accurately. There is no need for the user to get up out of the chair, make an approximate adjustment, try the new position, and then repeat the adjustment process several times to achieve the precise support and comfort levels desired. Also, the user does not need to twist or bend into an unnatural position to access the back adjustment actuator. Consequently, better back support and increased comfort are realized with vertically adjustable back construction 1. The present vertically adjustable back construction 1 is designed to permit upper back 5 to be adjusted a total of at least three inches between the fully lowered position shown in FIG. 1, and the fully raised position shown in FIG. 2. Within this range of travel, multiple vertical positions of at least 5–10 positions are available to achieve the precise lumbar support desired.

Furthermore, vertically adjustably back construction 1 not only permits easy and accurate adjustment of upper back 5, but it does so in a manner which preserves the one-piece sculptured appearance of chair 2. As noted above, FIG. 1 shows chair 2 with upper back 5 in its fully lowered position. In this condition, the overall configuration and appearance of chair 2 are substantially identical to the other "SENSOR" chairs disclosed in prior U.S. Pat. Nos. 4,776,633; 4,720,142; 4,709,894; 5,050,931; 4,744,603; D 311,286; D 309,383; D 312,536 and D 312,003. When upper back 5 is raised to the fully raised position shown in FIG. 2, the one-piece sculptured appearance of the "SENSOR" chair is maintained by the sliding action between the shroud 6 on upper back 5 and the underlying finished upright portion 4 of lower back 3. As a result, chair 2 is equipped with an improved vertically adjustable back construction for better support and comfort, while maintaining a common visual theme with other chairs that are not similarly adjustable.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a chair of the type having a one-piece back and seat appearance, the improvement of a vertically adjustable back construction therefor, comprising:

a lower back member having an upholstered upright portion, and a first connector associated therewith;

an upper back member including a second connector associated therewith which engages said first connector on the upright portion of said lower back member and movably supports said upper back member on said chair for vertical adjustment of the same; said upper back member including an upholstered, downwardly opening, four-sided shroud portion which is disposed over, covers and telescopes onto at least an uppermost end of the upright portion of said lower back member, and translates thereover to permit ready vertical adjustment of said upper back member by a user to accommodate various tasks and users, said shroud portion covering a front, a rear, and opposing sides of the uppermost end in a substantially wrinkle-free manner to preserve the one-piece back and seat appearance of said chair.

2. A chair as set forth in claim 1, wherein:

said shroud portion comprises an outwardly protruding pocket having an inverted U-shaped plan configuration into which the upright portion of said lower back member is closely received.

3. A chair as set forth in claim 1, wherein:

said upper back member is slidably mounted on said lower back member for manual adjustment of said upper back member by the user when seated on the chair.

4. A chair as set forth in claim 1, including:

an upholstered seat member integrally formed with said lower back member to provide a one-piece construction.

5. A chair as set forth in claim 1, wherein:

said lower back member and said upper back member each have marginal portions which blend together to impart a tapered waist area to said chair.

6. A chair as set forth in claim 1, wherein:

said lower back member includes a plurality of slide blocks thereon; and said upper back member includes a pair of rails thereon, which are slidably received in the slide blocks on said lower back member to movably interconnect said upper and lower back members for vertical translation therebetween.

7. A chair as set forth in claim 1, including:

a controller connected with said upper and lower back members to permit the same to tilt rearwardly.

8. A chair as set forth in claim 1, wherein:

said upper back member translates between a fully raised position and a fully lowered position; and including means for biasing said upper back member toward the fully lowered position.

9. A chair as set forth in claim 1 including a lock releasably connecting said upper back member with said lower back member to retain said upper back member in a selected vertical position, said back including a toothed rack on one of said upper and lower back members and a pawl on the other of said upper and lower back members for engaging the toothed rack.

10. A chair as set forth in claim 1, including:

a lock releasably connecting said upper back member with said lower back member to retain said upper back member at selected vertical positions.

11. A chair as set forth in claim 10, wherein:

said lock includes a remotely positioned actuator which can be manipulated by the user seated in a comfortable, forwardly facing position in said chair to facilitate quick and accurate adjustment of said upper back member.

12. A chair as set forth in claim 11, wherein:

said lock actuator is positioned along a lower edge of said upper back member and projects downwardly therefrom.

13. A chair as set forth in claim 12, wherein:

said shroud portion comprises an outwardly protruding pocket having an inverted U-shaped plan configuration into which the upright portion of said lower back member is closely received.

14. A chair as set forth in claim 13, wherein:

said upper back member is slidably mounted on said lower back member for manual adjustment of said upper back member by the user when seated on the chair.

15. A chair as set forth in claim 14, including:

an upholstered seat member integrally formed with said lower back member to provide a one-piece construction.

16. A chair as set forth in claim 15, wherein:

said seat member, said lower back member and said upper back member each have marginal portions which blend together to impart a generally hourglass shape to said chair.

17. A chair as set forth in claim 16, wherein:

said lower back member includes a plurality of slide blocks thereon; and said upper back member includes a pair of rails thereon, which are slidably received in the slide blocks on said lower back member to movably interconnect said upper and lower back members for vertical translation therebetween.

18. In a chair of the type having a one-piece back and seat appearance, the improvement of a vertically adjustable back construction therefor, comprising:

a lower back member having an upholstered upright portion, and a first connector associated therewith;

an upper back member including a second connector associated therewith which engages said first connector on the upright portion of said lower back member and movably supports said upper back member on said chair for vertical adjustment of the same; said upper back member including an upholstered, downwardly opening shroud portion which is disposed over, covers and telescopes onto at least an uppermost end of the upright portion of said lower back member, and translates thereover to permit ready vertical adjustment of said upper back member by a user to accommodate various tasks and users, while preserving the one-piece back and seat appearance of said chair;

a lock releasably connecting said upper back member with said lower back member to retain said upper back member at selected vertical positions; said lock including a remotely positioned actuator which can be manipulated by the user seated in a comfortable, forwardly facing position in said chair to facilitate quick and accurate adjustment of said upper back member; said lock actuator being positioned along a lower edge of said upper back member and projects downwardly therefrom;

said shroud portion comprising an outwardly protruding pocket having an inverted U-shaped plan configuration into which the upright portion of said lower back member is closely received;

said upper back member being slidably mounted on said lower back member for manual adjustment of said upper back member by the user when seated on the chair;

an upholstered seat member integrally formed with said lower back member to provide a one-piece construction;

said seat member, said lower back member and said upper back member each have marginal portions which blend together to impart a generally hourglass shape to said chair;

said lower back member including a plurality of slide blocks thereon; said upper back member including a pair of rails thereon, which are slidably received in the slide blocks on said lower back member to movably interconnect said upper and lower back members for vertical translation therebetween; and said lock including a toothed rack on said upper back member, and a reciprocating pawl on said lower back member which selectively engages said rack.

19. A chair as set forth in claim 18, including:

a controller movably interconnecting said seat member, said lower back member and said upper back member.

20. A chair as set forth in claim 19, wherein:

said controller is configured to permit said upper and lower back members to tilt rearwardly with respect to said seat member.

21. A chair as set forth in claim 20, wherein:

said controller is configured to tilt said seat member when said upper and lower back members are tilted to provide a synchrotilt chair motion.

22. A chair as set forth in claim 21, wherein:

said upper back member translates between a fully raised position and a fully lowered position; and including means for biasing said upper back member toward the fully lowered position.

23. A chair as set forth in claim 22, wherein:

said upper back member is vertically adjustable a distance of at least two inches between said fully raised and fully lowered positions.

24. A chair as set forth in claim 23, wherein:

said upper back member may be locked in at least five different vertical positions between said fully raised and fully lowered positions.

25. A chair, comprising:

a base;

a seat operably connected with said base, and having a user interface surface adapted to receive a seat portion of a seated user thereagainst;

a lower back member operably connected with said base, and including an upright portion with a first connector associated therewith; said lower back member having a user interface surface, which is positioned contiguous with the user interface surface of said seat, and is configured to mate with the same;

an upper back member having a second connector slidably engaging said first connector on the upright portion of said lower back member to movably support said upper back member on said chair for vertical adjustment of the same; said upper back member including a user interface surface adapted to receive a back portion of the user when seated thereagainst, which is positioned continuous with the user interface surface of said lower back member, and is configured to mate with the same, such that at least a forward portion of said chair has a one-piece back and seat appearance; said upper back member including a shroud portion, which is positioned over, covers and telescopes onto at least an uppermost end of the upright portion of said lower back member, and translates thereover to permit ready vertical adjustment of said upper back member by the user to accommodate various tasks and users, while preserving the one-piece back and seat appearance of said chair; and a lock releasably connecting said upper back member with said lower back member to retain said upper back member in a selected vertical position, said lock including a toothed rack on one of said upper and lower back members and a pawl on the other of said upper and lower back members for engaging the toothed rack.

26. A chair as set forth in claim 25, wherein:

said shroud portion of said upper back member comprises an outwardly projecting, downwardly opening pocket having an inverted U-shaped plan configuration into which the upright portion of said lower back member is closely received.

27. A chair as set forth in claim 26, wherein:

said seat, said lower back member and said upper back member have marginal portions which blend together to collectively define the one-piece back and seat appearance of said chair.

28. A chair as set forth in claim 27, wherein:

at least a forward portion of said chair has a generally hourglass shape.

29. A chair as set forth in claim 28, wherein:

said interface surfaces of said seat and said lower back member are integrally formed in a one-piece construction.

30. A chair as set forth in claim 29, wherein said lock includes:

a remotely controlled lock member releasably connecting said upper back member with said lower back member to retain the same at selected vertical positions.

31. A chair as set forth in claim 30, wherein:

said lock includes a remotely positioned actuator which can be manipulated by the user seated in a comfortable, forwardly facing position in said chair to facilitate quick and accurate adjustment of said upper back member.

32. A vertically adjustable back construction for chairs of the type having a one-piece back and seat appearance, comprising:

a lower back member having an upholstered upright portion, and a first connector associated therewith;

an upper back member including a second connector associated therewith which engages said first connector on the upright portion of said lower back member and movably supports said upper back member on an associated chair for vertical adjustment of the same; said upper back member including an upholstered, downwardly opening shroud portion defining an opening bounded on all sides by marginal material which is disposed over, covers and telescopes onto at least an uppermost end of the upright portion of said lower back member, and translates thereover to permit ready vertical adjustment of said upper back member by a user to accommodate various tasks and users, while preserving the one-piece back and seat appearance of the chair.

33. A vertically adjustable back construction as set forth in claim 32, including:

a lock having a remotely positioned actuator which can be manipulated by the user when seated in a comfortable, forwardly facing position in a chair incorporating said back construction to facilitate quick and accurate adjustment of said upper back member.

34. A vertically adjustable back construction as set forth in claim 33, wherein:

said lock actuator is positioned along a lower edge of said upper back member and projects downwardly therefrom.

35. A vertically adjustable back construction as set forth in claim 34, wherein:

said shroud portion comprises an outwardly protruding pocket having an inverted U-shaped plan configuration into which the upright portion of said lower back member is closely received.

36. A vertically adjustable back construction as set forth in claim 35, including:

an upholstered seat member integrally formed with said lower back member to provide a one-piece construction.

37. A vertically adjustable back construction as set forth in claim 36, wherein:

said lower back member includes a plurality of slide blocks thereon; and said upper back member includes a pair of rails thereon, which are slidably received in the slide blocks on said lower back member to movably interconnect said upper and lower back members for vertical translation therebetween.

38. A vertically adjustable back construction for chairs of the type having a one-piece back and seat appearance, comprising:

a lower back member having an upholstered upright portion, and a first connector associated therewith;

an upper back member including a second connector associated therewith which engages said first connector on the upright portion of said lower back member and movably supports said upper back member on an associated chair for vertical adjustment of the same; said upper back member including an upholstered, downwardly opening shroud portion which is disposed over, covers and telescopes onto at least an uppermost end of the upright portion of said lower back member, and translates thereover to permit ready vertical adjustment of said upper back member by a user to accommodate various tasks and users, while preserving the one-piece back and seat appearance of the chair;

a lock releasably connecting said upper back member with said lower back member to retain said upper back member at selected vertical positions; said lock including a remotely positioned actuator which can be manipulated by the user when seated in a comfortable, forwardly facing position in a chair incorporating said back construction to facilitate quick and accurate adjustment of said upper back member; said lock actuator being positioned along a lower edge of said upper back member and projects downwardly therefrom;

said shroud portion comprising an outwardly protruding pocket having an inverted U-shaped plan configuration into which the upright portion of said lower back member is closely received;

an upholstered seat member integrally formed with said lower back member to provide a one-piece construction;

said lower back member including a plurality of slide blocks thereon; said upper back member including a pair of rails thereon, which are slidably received in the slide blocks on said lower back member to movably interconnect said upper and lower back members for vertical translation therebetween; and said lock including a toothed rack on said upper back member, and a reciprocating pawl on said lower back member which selectively engages said rack.

39. A vertically adjustable back construction as set forth in claim 38, wherein:

said upper back member translates between a fully raised position and a fully lowered position; and including means for biasing said upper back member toward the fully lowered position.

40. In a chair of the type having a one-piece back and seat appearance, the improvement of a vertically adjustable back construction therefor, comprising:

a lower back member having an upholstered upright portion with upholstery material attached to an exterior surface thereof for non-collapsing movement with the upright portion, and a first connector associated therewith;

an upper back member including a second connector associated therewith which engages said first connector on the upright portion of said lower back member and movably supports said upper back member on said chair for vertical adjustment of the same; said upper back member including an upholstered, downwardly opening shroud portion which is disposed over and covers at least an uppermost end of the upright portion of said lower back member including at least an uppermost section of the exteriorly-attached upholstery material, and translates thereover to permit ready vertical adjustment of said upper back member by a user to accommodate various tasks and users, while preserving the one-piece back and seat appearance of said chair; and a lock releasably connecting said upper back member with said lower back member to retain said upper back member in a selected vertical position, said lock including a toothed rack on one of said upper and lower back members and a pawl on the other of said upper and lower back members for engaging the toothed rack.

* * * * *